US006441795B1

(12) United States Patent
Volman

(10) Patent No.: US 6,441,795 B1
(45) Date of Patent: Aug. 27, 2002

(54) CONICAL HORN ANTENNA WITH FLARE BREAK AND IMPEDANCE OUTPUT STRUCTURE

(75) Inventor: Vladimir Volman, Newtown, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 09/726,229

(22) Filed: Nov. 29, 2000

(51) Int. Cl.[7] ..... H01Q 13/00
(52) U.S. Cl. ..... 343/786; 343/895
(58) Field of Search ..... 343/785, 786, 343/895

(56) References Cited

U.S. PATENT DOCUMENTS 3,553,692 A * 1/1971 Drabowitch ..... 343/786
4,231,042 A * 10/1980 Turrin ..... 343/786
4,246,584 A * 1/1981 Noerpel ..... 343/786
4,255,753 A * 3/1981 Lovick, Jr. ..... 343/786
4,574,289 A * 3/1986 Henderson ..... 343/786
4,783,665 A * 11/1988 Lier et al. ..... 343/786
5,675,348 A * 10/1997 Okada et al. ..... 343/781 R
5,952,984 A * 9/1999 Kuramoto et al. ..... 343/911 R

* cited by examiner

*Primary Examiner*—Tan Ho
(74) *Attorney, Agent, or Firm*—Scully, Scott, Murphy & Presser

(57) ABSTRACT

A conical horn antenna that yields performance substantially equivalent to, or even greater than, that of a corresponding corrugated horn antenna while being simple and inexpensive to manufacture and light in weight. The body portion of the conical horn antenna is a conical horn antenna with a flare break positioned with respect to a central axis. At the output aperture of the body portion, a structure is located. The structure is a series of parallel rings, concentric to the common central axis, that are made of an electrically conductive material, and that are spaced at intervals to form a dielectric region between each ring. The dielectric region may be vacuum, air, free space or may contain a dielectric material. Alternatively, the structure is a helical winding, made of electrically conductive material, that spirals outwardly away from the central axis and forms a dielectric region between the turns of the winding. In a variation, the helical coil winding is surrounded by a jacket of dielectric material. In each case, the dielectric region substantially impedes the flow of electrical current through the wall of the horn antenna in the direction of the central axis.

40 Claims, 10 Drawing Sheets

CONICAL HORN ANTENNA WITH FLARE BREAK AND IMPEDANCE OUTPUT STRUCTURE

BACKGROUND OF THE INVENTION

The present invention relates generally to conical horn antennas used in commercial communications systems, including satellite communications, and more specifically to a conical horn antenna that yields performance substantially equivalent to, or even greater than, that of a corresponding corrugated horn antenna.

The ability of a horn antenna to produce the proper primary radiation pattern is determined by its size, shape, and internal structure, the latter interacting with the microwave energy. Other important factors are isolation as determined by cross-polarization purity, and also side-lobe performance. It is known in the art that for the operation of transmission/reception antennas having emission and two orthogonal polarizations, it is necessary to employ antennas preferably having low cross-polarization. A rotational-symmetrical radiation field and a low reflection factor are presumed. Corrugated horn antennas are especially used when there is a need for low cross-polarization and possible low side lobes across a large frequency range, for example, as a feeding element in reflector antennas or as an individual antenna element operating in the micro or millimeter-wave ranges.

Corrugated horn antennas, as illustrated in FIG. 1, are typically produced by electroforming an exterior surface 100, onto a reverse mold, called a mandrel. The mandrel is first machined to the tolerances required for the structure of the corrugations 110 of the horn. After electroplating, the exterior is machined to the desired shape, and the mandrel, which has a lower melting point than the antenna material, is melted out. Corrugated horn antennas, however, have been difficult to produce commercially, especially in the millimeter-wave range. This is due to the high production costs arising from the complicated structural characteristics and extreme accuracy that is required in machining the mandrel.

As a result, conventional conical type horn antennas often must be used even though the electrical characteristics are substantially below those of the corrugated type horn antenna. The conventional conical horn is very simple, easy to fabricate, and low in cost. However, the rotational symmetry is not perfect and the cross polarization level is in the range of −19 dB, as opposed to the desired low cross polarization level of −30 dB. The unequal E and H plane patterns in a conventional horn operating on its dominant transverse electrical ($TE_{11}$) mode result from different boundary conditions at the top and side parts of the circular waveguide. To correct this asymmetry, the same aperture field distribution at the E and H planes must be created. One method of correcting this asymmetry is by installing short-circuited quarter-wavelength grooves on the walls of the horn. Another method is by covering the horn walls with another type of impedance structure, such as a pure dielectric or a dielectric which has an impedance structure printed on it Other corrugated horn antennas are known in the art where the horn wall is made to be anisotropic and reactive, and it complies with the balanced hybrid condition of the hybrid $HE_{11}$ mode within the desired frequency band. Thus, the diagrams of radiation in the E and H planes will become almost alike and give low cross-polarization.

Even though this type of antenna has in principle, satisfactory characteristics, again, it is burdened with disadvantages with respect to production costs.

SUMMARY OF THE INVENTION

It is an object of this invention to create a horn antenna that has good electrical properties, substantially equivalent to, or better than, those of the corrugated type horn antenna, and is as easy, simple, and inexpensive to manufacture as the conical type horn antenna.

It is a further object of this invention to provide a conical horn without corrugations that permits an increase in radiated power above that of a conventional corrugated horn without electrical break down.

It is a further object of this invention to provide a broadband horn (8 to 18 GHz) which has a return loss of less than 30 dB in the frequency range of 10.7 GHz to 18 GHz.

In the present invention, a horn antenna, positioned with respect to a central axis, comprises a conical horn portion having two ends, one of the ends of greater diameter than the other end, the conical horn portion having a smooth interior wall without corrugations defining a cavity, the end of greater diameter defining an interfacing end. An output structure is positioned at the interfacing end of the conical portion, with the output structure having at least one dielectric region such that the flow of electrical current through the wall in the direction along the central axis is substantially impeded. The dielectric region preferably comprises vacuum, air, free space, or a dielectric material with very low losses. The impedance output structure is positioned at the interfacing end as a separate structure or is positioned at the interfacing end as a unitary construction with the conical portion.

In a different aspect of the embodiment, the conical horn portion can comprise at the end of lesser diameter a circular waveguide with a smooth interior wall without corrugations. The conical horn portion can further comprise a flare break portion at the end of greater diameter of the conical horn portion. The flare break portion has a smooth interior wall without corrugations, and has an aperture defining the interfacing end.

In one embodiment of the horn antenna, the impedance output structure further comprises at least one ring offset from the interfacing end of the conical portion by at least one post defining the at least one dielectric region between the interfacing end and the at least one ring. In a variation of the embodiment, the dielectric region further comprises a dielectric material disposed in at least a portion of the dielectric region.

In another embodiment of the horn antenna of the present invention, the impedance output structure is a helical coil winding, the turn of the winding forming at least one dielectric region between the winding and the interfacing end of the conical horn portion of the horn antenna. In a variation of the embodiment, the helical coil winding further comprises a dielectric jacket surrounding the winding.

In still another embodiment of the present invention, an array antenna comprises a plurality of horn antennas positioned with respect to a central axis, where at least one of the plurality of horn antennas comprises a conical horn portion having a wall defining an interior cavity and an interfacing end. An output structure is positioned at the interfacing end of the conical horn portion, the output structure having at least one dielectric region such that the flow of electrical current through the wall in the direction of the central axis is substantially impeded.

Due to the presence of a dielectric region between each ring or between the turns of the helical coil winding, the electrical current in the direction of the central axis that is induced by the tangential component of the magnetic field perpendicular to the axis is substantially prevented from flowing through the wall of the horn antenna, therein causing the cross-polarization level to decrease to the range of 27–35 dB.

DETAILED DESCRIPTION OF EXEMPLARY EMBODIMENTS

Figure 2:
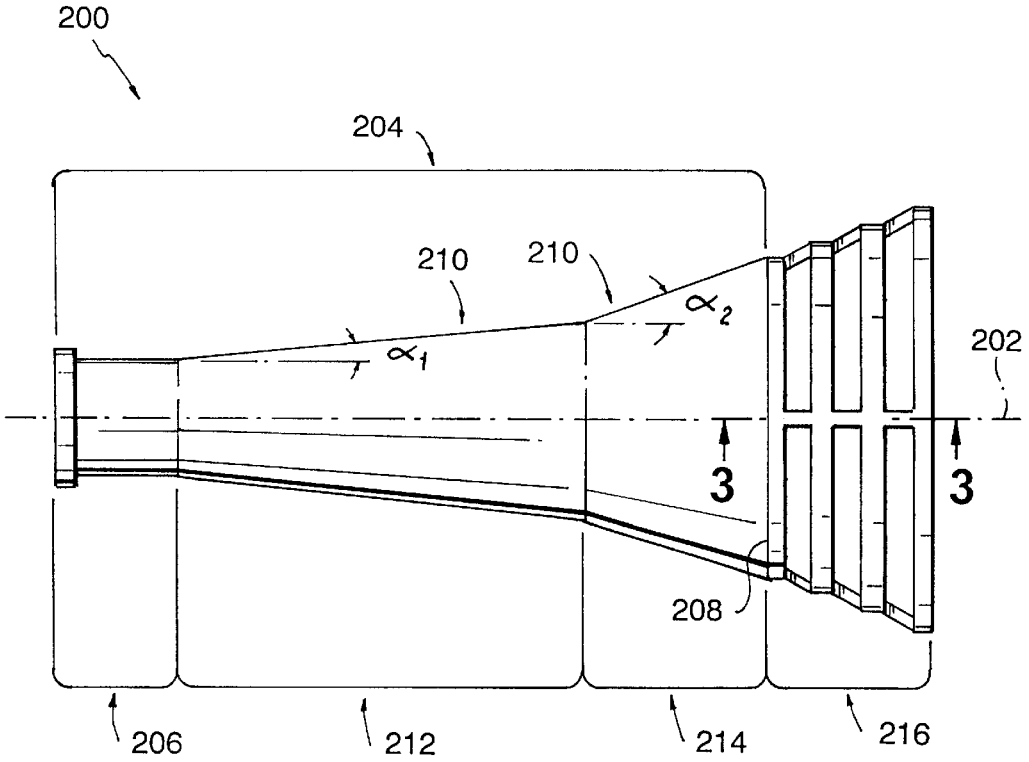
FIG. 2 illustrates a side view of one embodiment of the present invention comprising a conical horn with flare break and a ring structure as the impedance output structure.

Referring to FIG. 2, a first embodiment of the present invention as a horn antenna 200 positioned with respect to a central axis 202 and comprising a body portion 204. The body portion 204 is a conical horn with flare break with two ends: one end 206 is an input aperture portion comprising a circular waveguide; the other end is an interfacing end 208. The body portion 204 is preferably made from aluminum alloy 6061 T651, or any other suitable material as is known in the art.

The body portion 204 comprises a wall 210, the wall 210 having first and second portions 212 and 214, respectively. The wall 210 defines a first interior opening extending along the axis 202, the first portion 212 being inclined with respect to the axis 202 at an angle $\alpha 1$, the second portion 214 being inclined with respect to the axis 202 at an angle $\alpha 2$ which is greater than the angle of inclination of the first portion with respect to the axis, $\alpha 1$. The extremity of the flare of the second portion 214 forms the interfacing end 208 of the body portion 204 which interfaces with an output structure 216 which is positioned at the interfacing end 208 of the body portion 204. The output structure 216 is configured to comprise at least one dielectric region so that the flow of electrical current is substantially impeded in the direction of the central axis. The dielectric region preferably comprises vacuum, air, free space, or a dielectric material with very low losses.

Figure 3A:
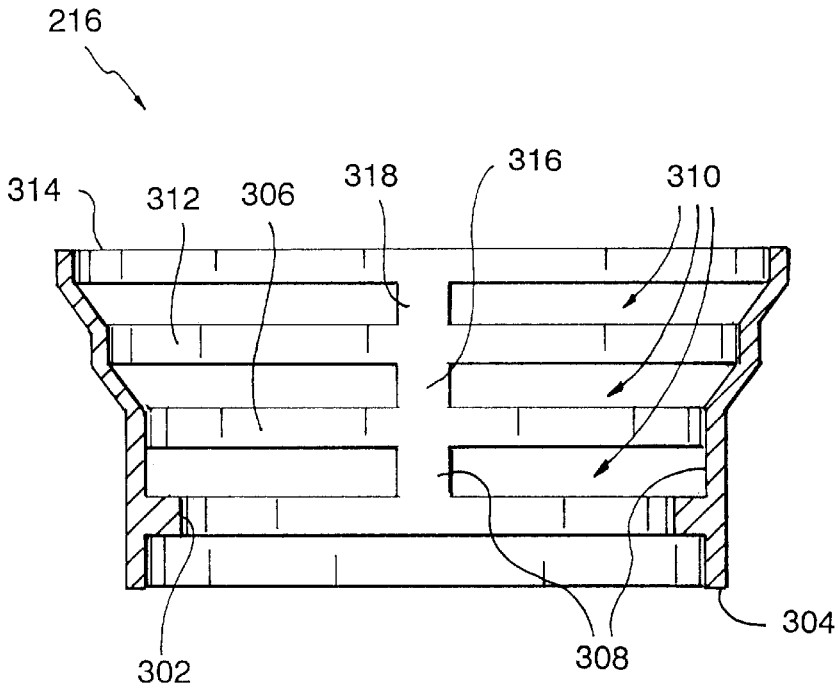
FIG. 3A illustrates a cross-sectional view, rotated 90°, of the ring structure of the conical horn of FIG. 2.
Figure 3B:
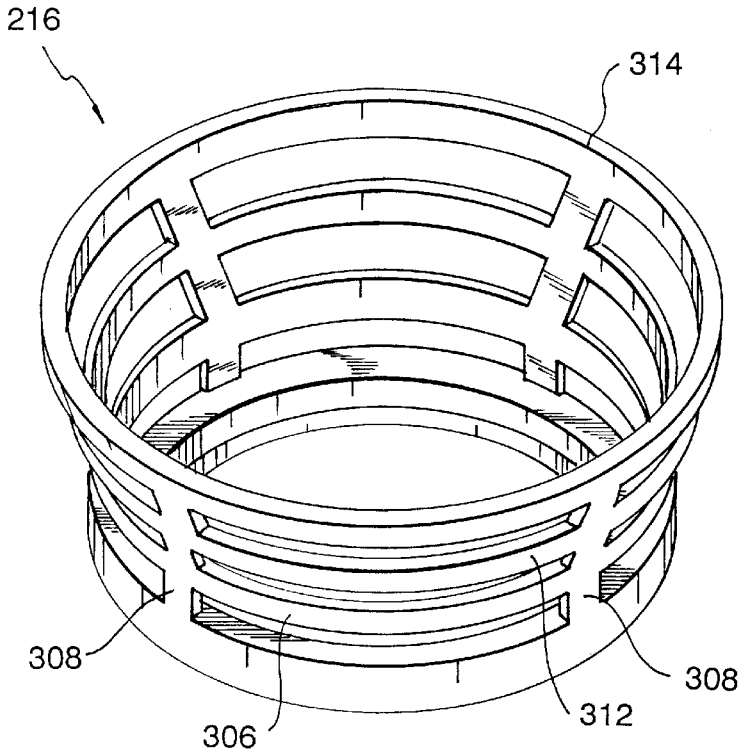
FIG. 3B illustrates a perspective view of the ring structure of the conical horn of FIG. 2.

Referring to FIG. 3A and FIG. 3B, the output structure 216 is shown in greater detail. The output structure 216 comprises a circular lip 302 having a counter-bore for locating and fixing an end 304 of the impedance output structure 216 to the interfacing end 208 of the body portion 204. The output structure 216 has at least one ring 306, normally parallel to the circular lip 302. The ring 306 is preferably made of electro-formed copper over a silver plated mandrel. The circular lip 302 and the ring 306 are typically concentric to the axis 202 and parallel to each other. The ring 306 and the circular lip 302 are separated from each other by at least one post 308, the post being of sufficient length but of narrow width to effect a dielectric region 310, typically comprised of free space, between the circular lip 302 and the ring 306 such that the dielectric region 310 extends substantially around the circumference of the ring 306 and the resulting dielectric constant is sufficient to substantially impede the flow of electrical current in the direction of the central axis 202 through one or more of the posts 308. The posts 308 are preferably made of material such as aluminum or copper and formed as a one-piece construction with the ring 306. Alternate constructions are that the posts 308 are made of a dielectric material such as polytetrafluoroethylene (Teflon™), or are separate pieces from the ring 306 and/or the circular lip 302. The electrical current through the wall 210 in the direction of central axis 202 is induced by the tangential component of the magnetic field perpendicular to the axis 202, and is deleterious to antenna performance. As a result of this minimization of the axial current, the cross-polarization level decreases to the range of 27 to 35 dB, and this is one of the advantages of the present invention. In accordance with the antenna performance requirements, additional rings such as 312 and 314 may be included and supported by posts 316 and 318 to form dielectric regions 310 alternating between each ring in succession along the central axis 202.

Figure 4:
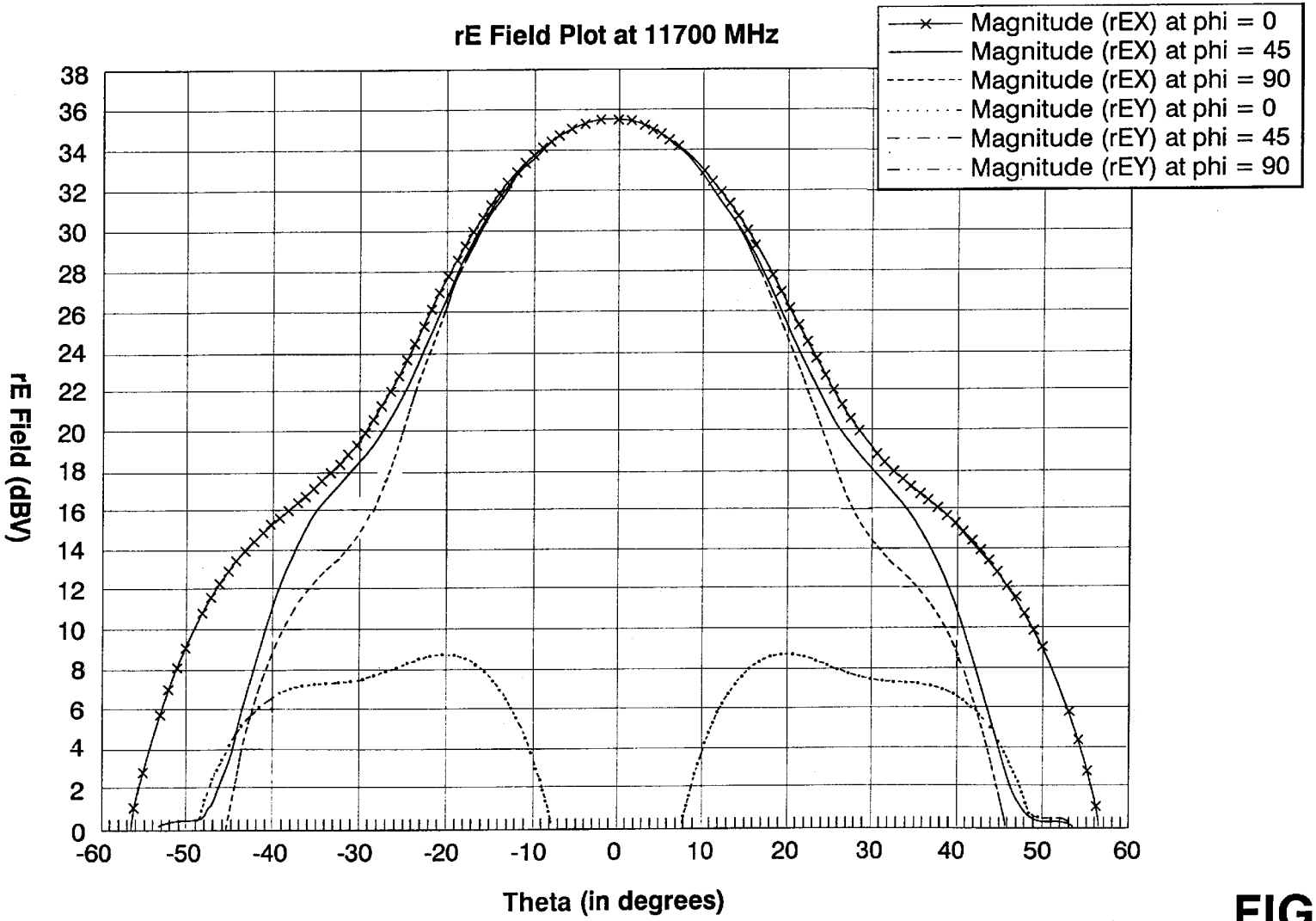
FIG. 4 illustrates the resultant electric field (rE) in decibel-volts (dBV) at 11,700 MHz (11.7 GHz) as a function of angle Theta (in degrees)in radial coordinates for various phase angles Phi(in degrees) showing the low cross polarization of the conical horn of FIG. 2.
Figure 5:
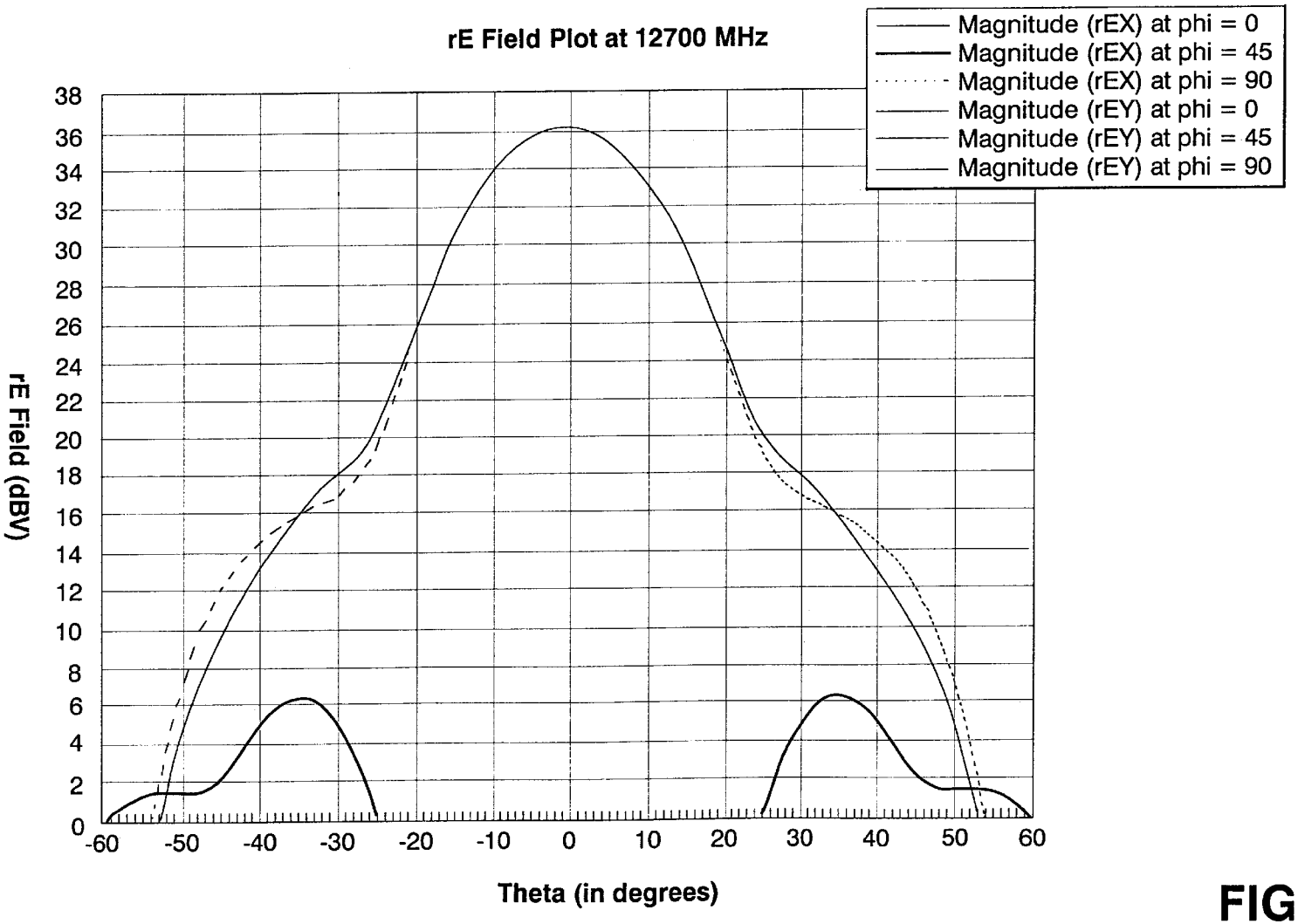
FIG. 5 illustrates the resultant electric field (rE) in decibel-volts (dBV) at 12,700 MHz (12.7 GHz) as a function of angle Theta (in degrees)in radial coordinates for various phase angles Phi(in degrees) showing the low cross polarization of the conical horn of FIG. 2.
Figure 6:
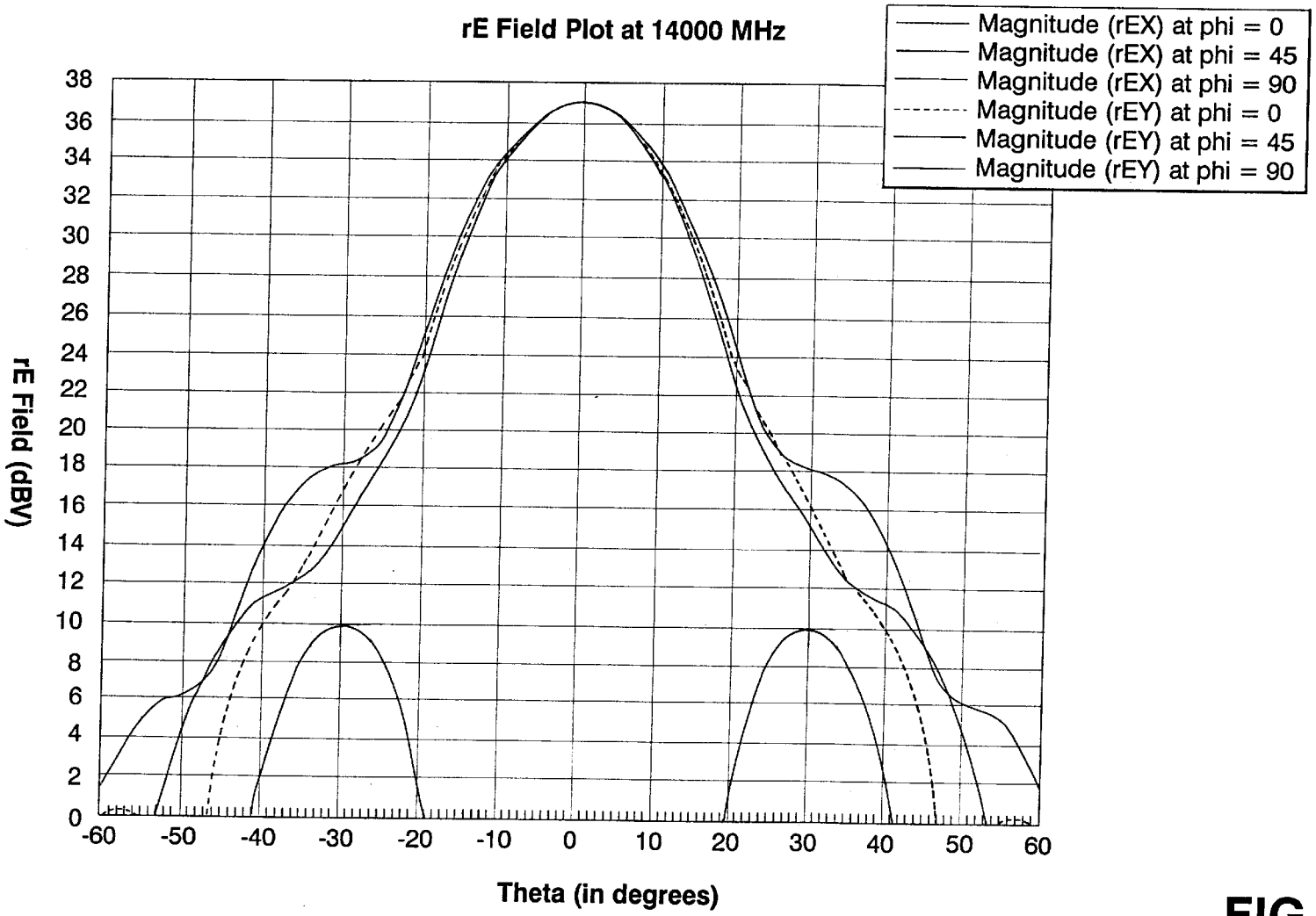
FIG. 6 illustrates the resultant electric field (rE) in decibel-volts (dBV) at 14,000 MHz (14.0 GHz) as a function of angle Theta (in degrees)in radial coordinates for various phase angles Phi(in degrees) showing the low cross polarization of the conical horn of FIG. 2.

A computer simulation of the performance of the horn antenna of FIG. 3 is shown in the resultant electric field plots of FIG. 4 , FIG. 5 and FIG. 6 for 11,700 MHz, 12,700 MHz and 14,000 MHz, respectively. Those skilled in the art will recognize that the horn antenna of FIG. 3 operates in a broad band range and has return losses below −30 dB from 10.7 GHz to 18 GHz. Those skilled in the art will also appreciate that the production cost of the horn antenna shown in FIG. 3 is much lower than a similar corrugated horn because of the simpler construction and reduced production accuracy requirements. As compared to a corrugated horn having a length of approximately 285 mm and an output aperture radius of 45 mm, the horn antenna shown in FIG. 3, with an equivalent output aperture radius of 45 mm, is lighter in weight by a factor of 9 or 10, weighing only about 200 grams, and is only about 200 mm long, yet yields the same performance as the corrugated horn.

Figure 7:
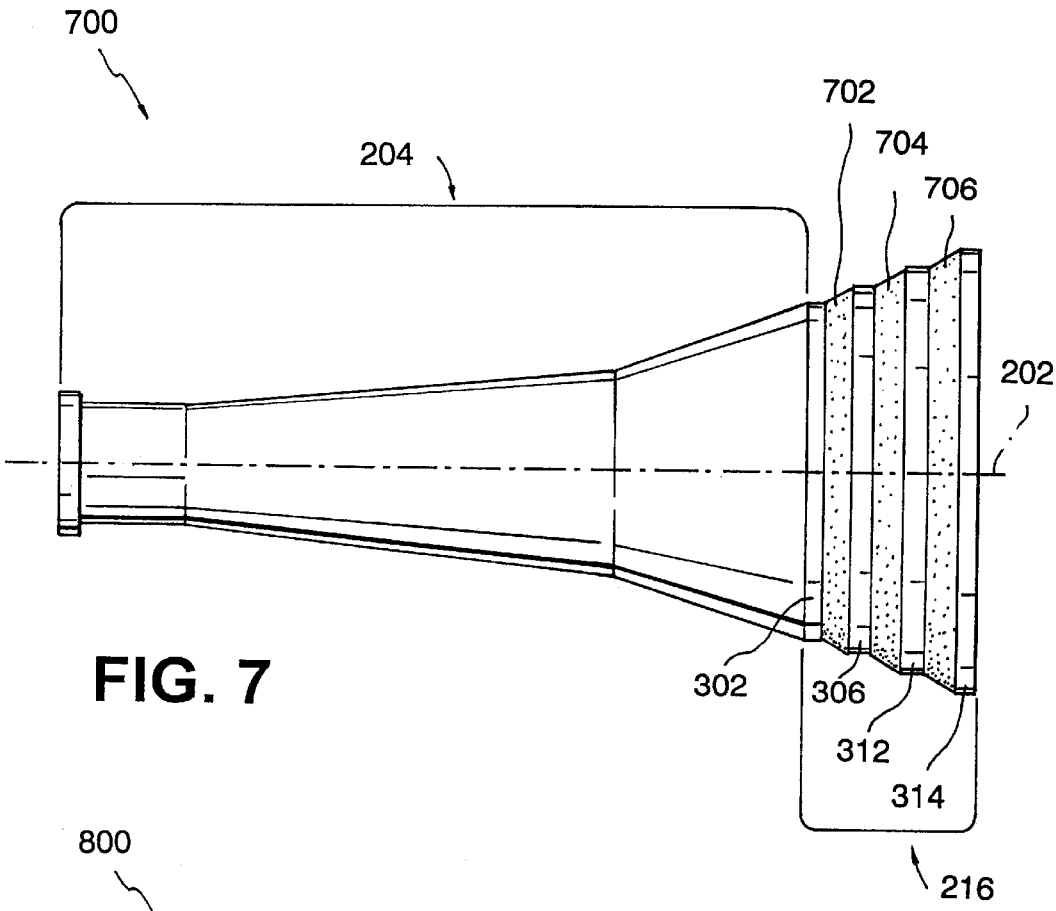
FIG. 7 illustrates a side view of an alternate embodiment of the conical horn of FIG. 2 having a ring structure comprising dielectric material in the impedance output structure.

Referring now to FIG. 7, a variation of the horn antenna is shown and generally indicated by reference number 700, wherein hollow conical spacers 702, 704, and 706 are installed in the dielectric regions between the circular lip 302 and ring 306, between rings 306 and 312, and between rings 312 and 314, respectively. The spacers 702, 704, and 706 are preferably in contact with, and maintained in position by, the rings 306, 312 and 314. The spacers 702, 704, and 706 are made preferably of a dielectric material such as polytetrafluoroethylene (Teflon™).

Alternatively, the rings 306, 312 and 314 may be conical and the posts 308 may be oriented parallel to the axis 202. Similarly, the rings 306, 312 and 314 may be conical and the dielectric spacers 702, 704, and 706 may be circular, or the rings and posts or rings and dielectric spacers all circular or all conical, or other combinations as may be suitable for manufacturing, structural, or performance requirements. Those skilled in the art will recognize that FIG. 2, FIG. 3A, FIG. 3B and FIG. 7 show the body portion 204 and the impedance output structure 216 as separate entities but that the body portion 204 and the impedance output structure 216 can be constructed as a unitary entity.

Figure 8:
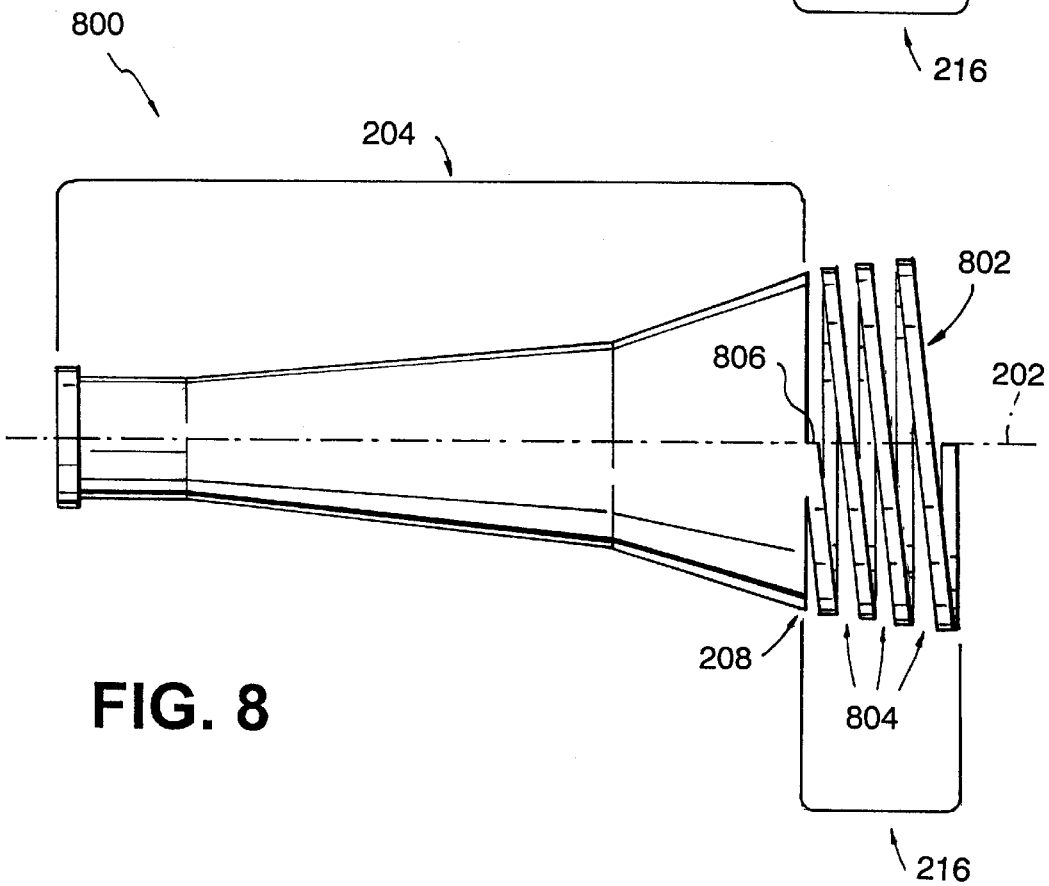
FIG. 8 illustrates a side view of another embodiment of the conical horn of the present invention having a helical coil winding as the impedance output structure.

Referring now to FIG. 8, there is illustrated a second embodiment of the present invention where the horn antenna 800 again comprises the body portion 204 of FIG. 2 but the impedance output structure 216 comprises a finite helical coil winding 802 which preferably spirals outwardly away from the central axis 202 and which is configured to form a dielectric region 804 between the windings. The helical coil winding 802 is normally wound of at least one turn, but may be wound of a partial turn and the end of the winding 806 is positioned at the interfacing end 208 of the body portion 204. The turn or turns preferably increase in diameter along the central axis 202 forming a spiral and the turns are preferably concentric with the central axis 202. The winding 802 is made preferably of an electrically conductive material such as copper or aluminum.

Figure 9:
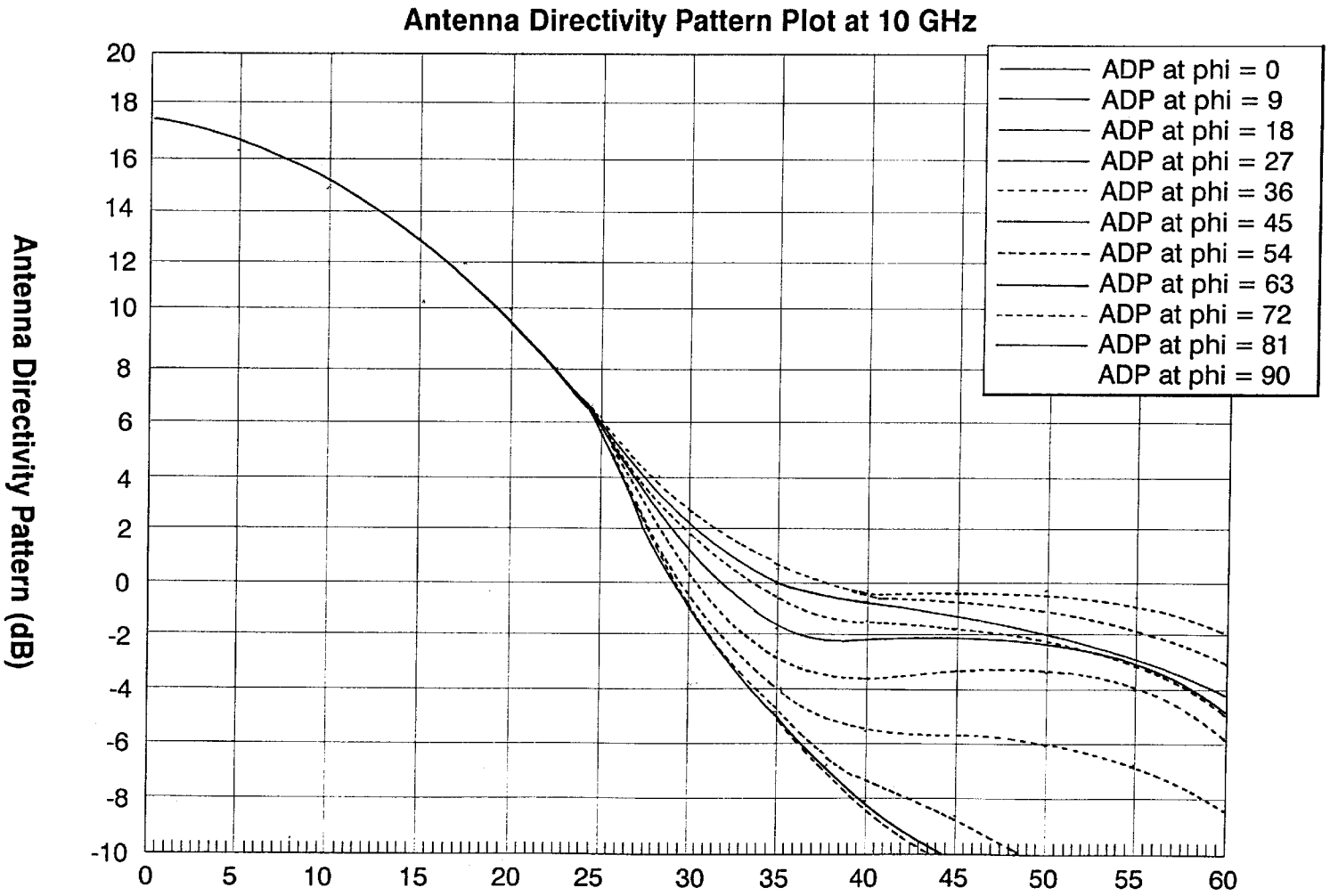
FIG. 9 illustrates the azimuth beam pattern in decibels at 10 GHz at various phase angles Phi (in degrees) of the conical horn of FIG. 8.
Figure 10:
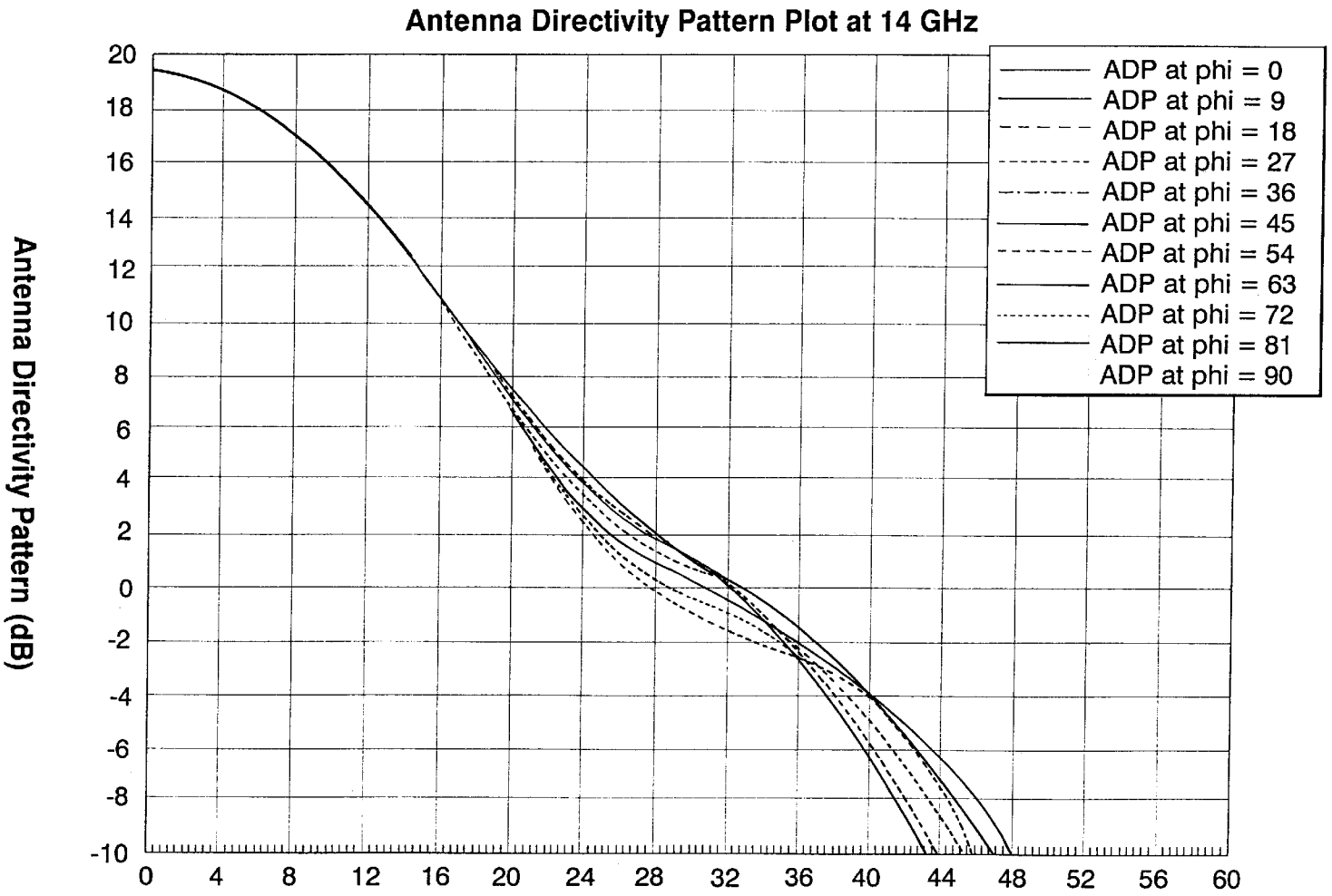
FIG. 10 illustrates the azimuth beam pattern in decibels at 14 GHz at various phase angles Phi (in degrees) of the conical horn of FIG. 8.

A computer simulation of the performance of the horn antenna of FIG. 8 is shown in the antenna directivity pattern plots of FIG. 9 and FIG. 10 for 10 GHz and 14 GHz, respectively.

Those skilled in the art will recognize that the horn antenna of FIG. 8 operates in a broad band range and has return losses below −30 dB from 10.7 GHz to 18 GHz. Those skilled in the art will also appreciate that the production cost of the horn antenna shown in FIG. 8 is much lower than a similar corrugated horn because of the simpler construction and reduced production accuracy requirements.

Referring now to FIG. 11, an alternate embodiment of the horn antenna of FIG. 8 is illustrated in FIG. 11 where the horn antenna 1100 of FIG. 11 again comprises the body portion 204 of FIG. 2 and the helical coil winding 802 of FIG. 8 but a conical dielectric jacket 1102 surrounds the turns of the winding 802. Preferably the conical dielectric jacket 1102 is in contact with, and is maintained in position by, the turns of the winding 802. The conical dielectric jacket 1102 is made preferably of a dielectric material such as polytetrafluoroethylene (Teflon™).

Figure 11:
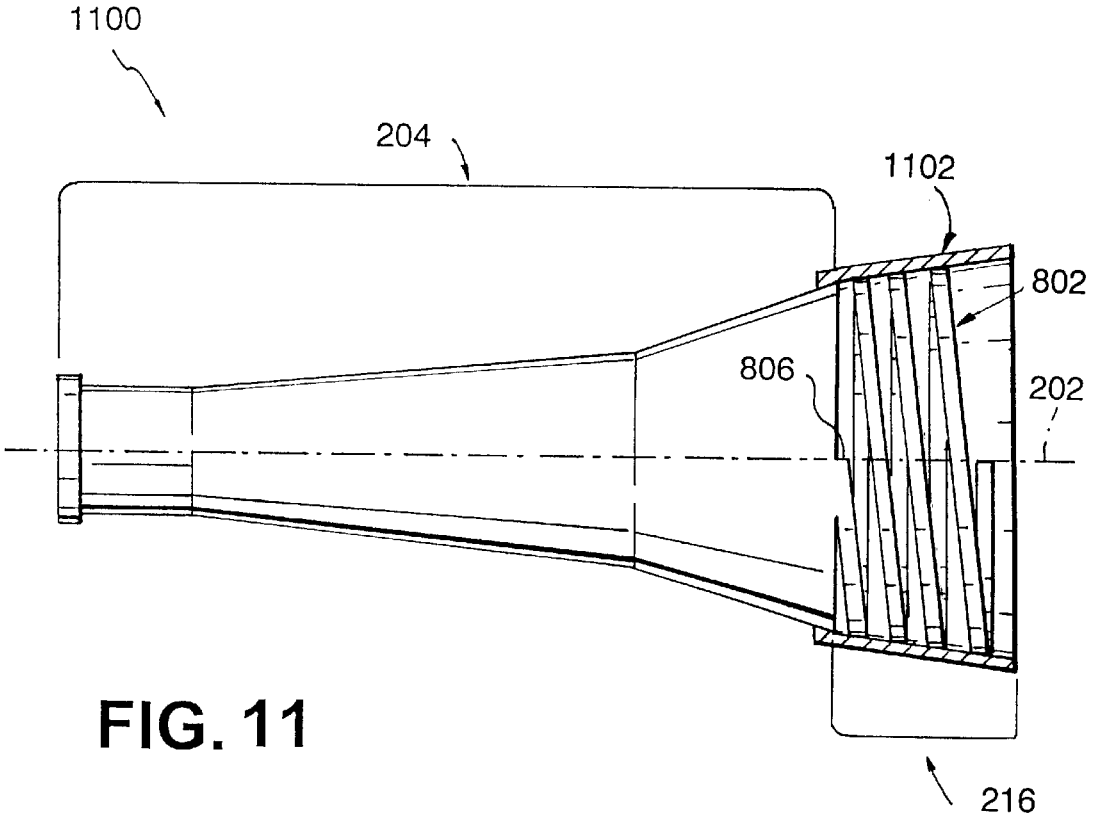
FIG. 11 illustrates a side view of an alternate embodiment of the conical horn of FIG. 8 where a dielectric jacket surrounds the helical coil winding.

Those skilled in the art will recognize that FIG. 8 and FIG. 11 show the body portion 204 and the impedance output structure 216 as separate entities but that the body portion 204 and the impedance output structure 216 can be constructed as a unitary entity.

Figure 12:
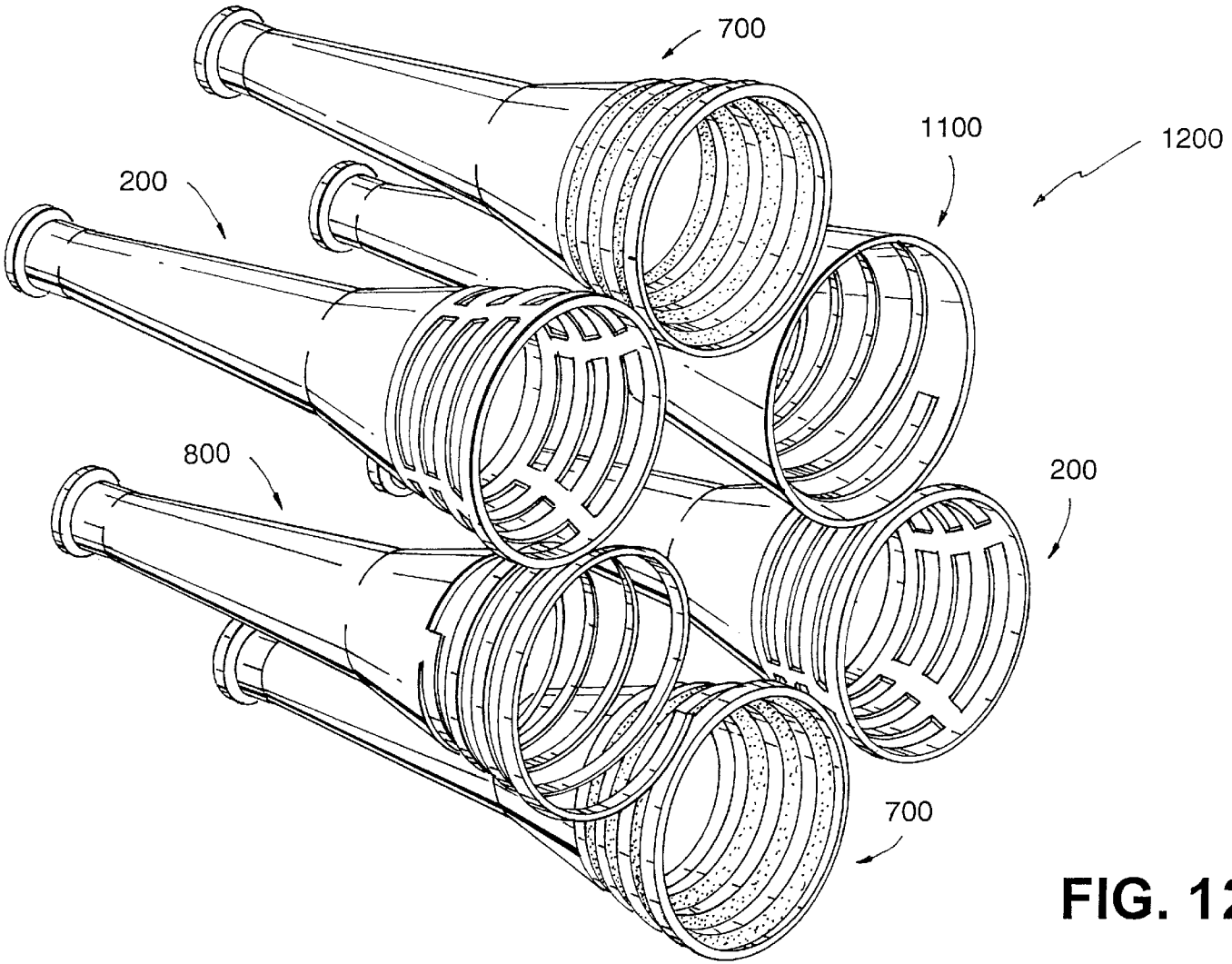
FIG. 12 illustrates an array antenna system having the horn antennas as described in the present invention.

FIG. 12 illustrates an array antenna system which comprises any one of the horn antennas 300, 700, 800, or 1100 described in the foregoing specification and drawings.

Figure 1:
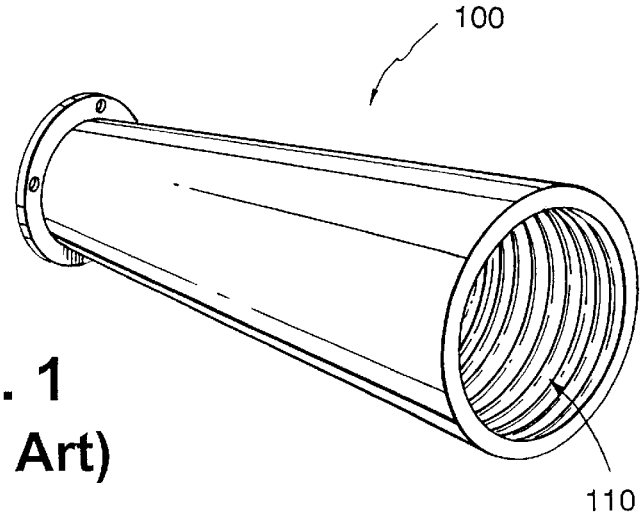
FIG. 1 (Prior Art)
FIG. 1 illustrates a conventional C- or Ku-band corrugated horn showing the internal corrugations.

The present invention has electrical characteristics which are either similar to or greater than the conventional corrugated horn 100, shown in FIG. 1, while it is also simple to construct, light in weight and inexpensive to manufacture. The density of the resulting electromagnetic energy is very low in the region of the output structure, based on the large radius of the output structure as compared to the small radius of the conical waveguide at the input aperture. Therefore, the amount of power radiated without breakdown can be several times that of a corresponding corrugated horn. Due to this feature of low probability of electrical breakdown, the conical horn of the present invention can be useful in high power applications, such as in the MW range for radar antennas.

The invention has now been explained with reference to specific embodiments. Other embodiments will be apparent to those of ordinary skill in the art in view of the foregoing description. It is not intended that this invention be limited except as indicated by the appended claims and their full scope equivalents.

What is claim is:

1. A horn antenna positioned with respect to a central axis comprising a conical horn portion including two ends, one of the ends of greater diameter than the other end, the conical horn portion including a smooth interior wall without corrugations defining a cavity, the end of greater diameter defining an interfacing end; and an output structure positioned at the interfacing end, the output structure including at least one dielectric region such that the flow of electrical current through the wall in the direction of the central axis is substantially impeded, wherein the output structure includes at least one ring offset from the interfacing end of the conical horn portion by at least one post defining the at least one dielectric region between the interfacing end and the at least one ring.

2. The horn antenna according to claim 1, wherein the conical horn portion and the output structure are of unitary construction.

3. The horn antenna according to claim 1, wherein the output structure is of unitary construction.

4. The horn antenna according to claim 1, wherein the output structure further comprises a counter-bore having a lip for locating and fixing an end of the output structure to the interfacing end of the conical horn portion.

5. The horn antenna according to claim 1, wherein the at least one ring is parallel to the interfacing end of the conical horn portion of the horn antenna.

6. The horn antenna according to claim 1, wherein the at least one ring is concentric with the central axis.

7. The horn antenna according to claim 1, further comprising a dielectric material disposed in at least a portion of the dielectric region.

8. The horn antenna according to claim 1, wherein the at least one ring comprises two or more rings, the two or more rings comprising a first ring operatively connected to the conical horn portion at the interfacing end with at least one post, and succeeding rings in series therein positioned by at least one post between each ring to define dielectric regions alternating between each ring in succession along the central axis.

9. The horn antenna according to claim 8, further comprising a dielectric material disposed in at least a portion of one or more of the dielectric regions.

10. The horn antenna according to claim 8, wherein the two or more rings are parallel to the interfacing end of the conical horn portion.

11. The horn antenna according to claim 8, wherein the two or more rings are concentric with the central axis.

12. The horn antenna according to claim 8, wherein diameters of succeeding rings progressively increase in succession along the central axis.

13. The horn antenna according to claim 1, wherein the conical horn portion further comprises at the end of lesser diameter a circular waveguide with a smooth interior wall without corrugations.

14. The horn antenna according to claim 1, wherein the dielectric region comprises one of (a)vacuum, (b)air, (c)free space, and (d)a dielectric material with very low losses.

15. The horn antenna according to claim 14, wherein the dielectric material with very low losses comprises polytetrafluoroethylene.

16. The horn antenna of claim 1, wherein the at least one post comprises one of (a)aluminum, (b)copper, and (c)dielectric material.

17. The horn antenna according to claim 16, wherein the dielectric material comprises polytetrafluoroethylene.

18. A horn antenna positioned with respect to a central axis comprising a conical horn portion including two ends, one of the ends of greater diameter than the other end, the conical horn portion including a smooth interior wall without corrugations defining a cavity, the end of greater diameter defining an interfacing end; and an output structure positioned at the interfacing end, the output structure including at least one dielectric region such that the flow of electrical current through the wall in the direction of the central axis is substantially impeded, wherein the output structure is a helical coil winding.

19. The horn antenna according to claim 18, wherein the helical coil winding comprises:

a winding of less than one turn positioned at the interfacing end of the conical horn portion, the turn of the winding forming the at least one dielectric region between the winding and the interfacing end of the conical horn portion.

20. A The horn antenna according to claim 19 further comprising a dielectric jacket surrounding the helical coil winding.

21. The horn antenna according to claim 20, wherein the dielectric jacket comprises polytetrafluoroethylene.

22. The horn antenna according to claim 18, wherein the helical coil winding comprises a winding of at least one or more turns positioned at the interfacing end of the conical horn portion, the at least one or more turns of the winding forming the at least one dielectric region between the winding and the interfacing end of the conical horn portion.

23. The horn antenna according to claim 22, wherein the diameter of each turn of the winding increases in succession from the winding proximate the interfacing end of the conical horn portion to a finite end of the helical coil winding.

24. The horn antenna according to claim 17 further comprising a dielectric jacket surrounding the helical coil winding.

25. The horn antenna according to claim 24, wherein the dielectric jacket comprises polytetrafluoroethylene.

26. The horn antenna according to claim 18, wherein the helical coil winding comprises one of (a)aluminum, and (b)copper.

27. The horn antenna according to claim 18, wherein the conical horn portion and the output structure are of unitary construction.

28. The horn antenna according to claim 18, wherein the output structure is of unitary construction.

29. The horn antenna according to claim 18, wherein the output structure further comprises a counter-bore having a lip for locating and fixing an end of the output structure to the interfacing end of the conical horn portion.

30. The horn antenna according to claim 18, wherein the conical horn portion further comprises at the end of lesser diameter a circular waveguide with a smooth interior wall without corrugations.

31. The horn antenna according to claim 18, wherein the dielectric region comprises one of (a)vacuum, (b)air, (c)free space, and (d)a dielectric material with very low losses.

32. An array antenna comprising a plurality of horn antennas positioned with respect to a central axis, at least one of the plurality of horn antennas comprising a conical horn portion including two ends, one of the ends of greater diameter than the other end, the conical horn portion including a smooth interior wall without corrugations defining a cavity, the end of greater diameter defining an interfacing end; and an output structure positioned at the interfacing end of the conical horn portion, the output structure including at least one dielectric region such that the flow of electrical current through the wall in the direction of the central axis is substantially impeded, wherein the output structure includes at least one ring offset from the interfacing end of the conical horn portion by at least one post defining the at least one dielectric region between the interfacing end and the at least one ring.

33. A horn antenna positioned with respect to a central axis comprising a conical horn portion including two ends, one of the ends of greater diameter than the other end, the conical horn portion including a smooth interior wall without corrugations defining a cavity, the end of greater diameter defining an interfacing end;

an output structure positioned at the interfacing end, the output structure including at least one dielectric region such that the flow of electrical current through the wall in the direction of the central axis is substantially impeded, wherein the conical horn portion includes a flare break portion at the end of greater diameter of the conical horn portion, the flare break portion including a smooth interior wall without corrugations, the flare break portion including an aperture, the aperture of the flare break portion defining the interfacing end of the conical horn portion.

34. The horn antenna according to claim 33, wherein the conical horn portion and the output structure are of unitary construction.

35. The horn antenna according to claim 33, wherein the output structure is of unitary construction.

36. The horn antenna according to claim 33, wherein the output structure further comprises a counter-bore having a lip for locating and fixing an end of the output structure to the interfacing end of the conical horn portion.

37. The horn antenna according to claim 33, wherein the conical horn portion further comprises at the end of lesser diameter a circular waveguide with a smooth interior wall without corrugations.

38. The horn antenna according to claim 33, wherein the dielectric region comprises one of (a)vacuum, (b)air, (c)free space, and (d)a dielectric material with very low losses.

39. An array antenna comprising a plurality of horn antennas positioned with respect to a central axis, at least one of the plurality of horn antennas comprising a conical horn portion including two ends, one of the ends of greater diameter than the other end, the conical horn portion including a smooth interior wall without corrugations defining a cavity, the end of greater diameter defining an interfacing end;

and an output structure positioned at the interfacing end of the conical horn portion, the output structure including at least one dielectric region such that the flow of electrical current through the wall in the direction of the central axis is substantially impeded, wherein the output structure is a helical coil winding.

40. An array antenna comprising a plurality of horn antennas positioned with respect to a central axis, at least one of the plurality of horn antennas comprising a conical horn portion including two ends, one of the ends of greater diameter than the other end, the conical horn portion including a smooth interior wall without corrugations defining a cavity, the end of greater diameter defining an interfacing end; and an output structure positioned at the interfacing end of the conical horn portion, the output structure including at least one dielectric region such that the flow of electrical current through the wall in the direction of the central axis is substantially impeded, wherein the conical horn portion includes a flare break portion at the end of greater diameter of the conical horn portion, the flare break portion including a smooth interior wall without corrugations, the flare break portion including an aperture, the aperture of the flare break portion defining the interfacing end of the conical horn portion.

* * * * *